US005634504A

United States Patent [19]

Chandler

[11] Patent Number: 5,634,504

[45] Date of Patent: Jun. 3, 1997

[54] VENTING AND FLOW CONTROL CLOSURE DEVICE HAVING REPEATING VENTED FRACTURE PATTERN

[76] Inventor: Herman R. Chandler, 31 Shafor Cir., Dayton, Ohio 45409-2337

[21] Appl. No.: 535,764

[22] Filed: Sep. 28, 1995

[51] Int. Cl.[6] ..... B65B 1/04; B65B 3/04; B67C 3/00

[52] U.S. Cl. ..... 141/285; 141/114; 141/366; 141/392; 222/541.4; 220/258; 220/89.2; 215/232; 215/250; 215/253

[58] Field of Search ..... 141/285, 114, 141/364, 366, 388, 389, 392; 222/541.4; 220/258, 89 A, 375; 215/232, 250, 253, 306, 325

[56] References Cited

U.S. PATENT DOCUMENTS

| | | | |
|---|---|---|---|
| 4,452,382 | 6/1984 | Von Holdt | 222/529 |
| 4,696,328 | 9/1987 | Rhodes, Jr. | 141/1 |
| 4,872,571 | 10/1989 | Crecelius et al. | 215/232 |
| 4,938,390 | 7/1990 | Markva | 222/206 |
| 4,949,857 | 8/1990 | Russell | 215/253 |
| 5,044,531 | 9/1991 | Rhodes, Jr. | 222/541 |
| 5,123,570 | 6/1992 | Dubow et al. | 222/83 |
| 5,249,714 | 10/1993 | Merhar | 222/500 |
| 5,316,058 | 5/1994 | Spektor et al. | 141/319 |
| 5,472,021 | 12/1995 | Tsao et al. | 222/541.4 |

*Primary Examiner*—Henry J. Recla
*Assistant Examiner*—Timothy L. Maust
*Attorney, Agent, or Firm*—John R. Flanagan

[57] ABSTRACT

A venting and flow control closure device includes a disc having a peripheral sealing area attachable to a rim which encircles a dispensing opening of a liquid container and a repeating vented fracture pattern formed on the disc and extending from one edge to an opposite edge of the sealing area of the disc. The disc is made substantially of a metal foil material. The repeating fracture pattern is formed of a plurality of alternating vents and rupturable bridges. Each vent has a length substantially greater than the length of each bridge. The repeating fracture pattern has a central portion zig-zag in shape with peaks and valleys terminating in a plurality of round holes, and a pair of opposite side portions extending outwardly from the round holes of the central portion in substantially perpendicular relation to an imaginary line dividing the zig-zag pattern of the central portion into halves with all of the peaks in one half and all of the valleys in the other half. These outwardly extending portions of the repeating fracture pattern terminate in the peripheral sealing area of the disc. The alternating vents and rupturable bridges and the repeating fracture pattern formed therewith enable the disc to be attached to the rim of the dispensing opening of the container without the need for centering or indexing the design in the installation process.

22 Claims, 2 Drawing Sheets

VENTING AND FLOW CONTROL CLOSURE DEVICE HAVING REPEATING VENTED FRACTURE PATTERN

BACKGROUND OF THE INVENTION

1. Field of the Invention

The present invention generally relates to devices for controlling the flow of liquids from containers and, more particularly, is concerned with a venting and flow control closure device having a repeating vented fracture pattern for a dispensing opening of a liquid container.

2. Description of the Prior Art

In recent decades, automobile engine compartments have become increasingly more compact due largely to many of the automobiles themselves becoming more compact with the goal being to improve on aerodynamic characteristics and thereby to improve on fuel efficiency of the vehicle. This reduction in engine compartment size has eliminated nearly all of the previously available space around the engine oil filler opening, which has made it difficult for many automobile users to lower a container of motor oil to a normal pouring position without a considerable amount of oil spillage taking place on the engine around the oil filler opening. The spilled oil may then become an environmental hazard and undesirable waste.

While the oil industry has made some changes in the shapes of the oil containers such as longer filler necks and moving the neck from the center to one side of the container, none of these improvements have significantly prevented oil from spilling as the uncapped container is inverted to be placed over the oil filler opening. As a result, a variety of devices have been proposed over the years to address this problem of oil spillage under the hood of automobiles. Representative examples of these devices are disclosed in U.S. Pat. No. 4,452,382 to Von Holdt, U.S. Pat. Nos. 4,696,328 and 5,044,531 to Rhodes, Jr., U.S. Pat. No. 4,872,571 to Crecelius et al., U.S. Pat. No. 4,938,390 to Markva, U.S. Pat. No. 4,949,857 to Russell, U.S. Pat. No. 5,123,570 to Dubow et al., U.S. Pat. No. 5,249,714 to Merhar and U.S. Pat. No. 5,316,058 to Spektor et al.

These prior art devices generally provide either an improved valve structure on the filler neck of the liquid container or a seal covering the dispensing opening which can be ruptured by a pull tab or another like means or by squeezing opposite sides of the container to release the container's contents. Of the prior art devices, only the patents to Markva and to Russell appear to disclose a seal having a fracture pattern therein. The Markva patent in particular provides perforations for initiating fracture of the seal, but fails to recognize the need to equalize pressure within the liquid container to the atmospheric pressure prior to use. These pressures imposed by changes of altitude, temperature or barometric condition may exceed the actuating pressure.

The inventor herein is first to recognize that a fracture pattern on the seal has a dual function. First, it permits automatic adjustment of the internal pressure of the container to the atmospheric pressure by allowing air to be exchanged through holes cut therein. Second, it retains the integrity of the seal by allowing liquid stored in the container to pass through the holes only at a rate which provides sufficient time for a user to place an uncapped inverted container over a filler opening for reception of the container's contents before drops of the liquid begin to seep out through the perforations of the fracture pattern. The seal may then be ruptured by the user squeezing the opposite sides of the container and thereby forcing liquid through the fracture pattern. The force generated by the user squeezing on the container is approximately 0.2 psi. Therefore, the vent fracture system parts must be highly accurate in the controlling function.

A problem generally exists, however, with the prior art fracture patterns in that they are normally discrete and therefore appear to require considerable centering control in the process of installation of the seal onto a rim encircling a container dispensing opening. This centering control requirement seems to unnecessarily add to the complexity and the costs of the seal installation process. The inventor herein has provided a solution to the aforementioned problem which further retains the dual functions of the fracture pattern.

Consequently, a need still exists for a device which overcomes the aforementioned problems in the prior art devices without introducing any new problems in their place.

SUMMARY OF THE INVENTION

The present invention provides a venting and flow control closure device having a repeating vented fracture pattern for the dispensing opening of a liquid container designed to satisfy the aforementioned need in the prior art. The repeating nature of the fracture pattern of the present invention provides the device with its principal advantage over the prior art devices in that it requires no indexing in the installation process. The necessity for indexing generally arises, as described above with regard to the prior art, when the fracture pattern is discrete and therefore requires centering of the design over the dispensing opening of the container before the seal is attached to the rim of the dispensing opening. In the present invention, however, the repeating fracture pattern eliminates any need to center or index the design during installation.

Accordingly, the present invention is directed to a venting and flow control closure device which comprises: (a) a disc having a peripheral sealing area attachable to a rim which encircles a dispensing opening of a liquid container; and (b) means defining a repeating vented fracture pattern formed on the disc and extending from one edge to an opposite edge of the sealing area of the disc. The repeating fracture pattern of the present invention is adapted to provide automatic adjustment of the internal pressure of the liquid container to the atmospheric pressure by allowing air to be exchanged therethrough and is adapted to allow for passage of the liquid stored in the container at a rate which provides sufficient time for a user to place an uncapped inverted container over a filler opening for reception of the contents of the container before drops of liquid begin to seep out through the repeating fracture pattern, which is then rupturable by the user squeezing the container and forcing liquid therethrough.

More particularly, the disc is made substantially of a metal foil material. The means defining the repeating fracture pattern is a plurality of alternating vents and rupturable bridges. Each vent has a length substantially greater than the length of each bridge. The length of each bridge also substantially determines the pressure at which the bridge will rupture. An increase in the lengths of the bridges necessitates a decrease in the lengths of the vents thereby reducing the degree to which the metal foil material is weakened by the presence of the vents and accordingly increasing the pressure required to rupture the bridges. The peripheral sealing area of the disc further has a width across the rim of the liquid container substantially greater than the length of each vent so that a continuous bond exists between the disc and the rim. This ensures that after the peripheral sealing area of the disc is attached to the rim of the dispensing opening of the container, it will remain attached thereto even after the repeating fracture pattern of the disc is ruptured.

Furthermore, the repeating fracture pattern has a central portion substantially zig-zag in shape with peaks and valleys terminating in a plurality of round holes. The repeating fracture pattern further has a pair of opposite side portions extending outwardly from the round holes of the central portion in substantially perpendicular relation to an imaginary line dividing the zig-zag pattern of the central portion into halves with all of the peaks in one half and all of the valleys in the other half. These outwardly extending opposite side portions of the repeating fracture pattern terminate in the peripheral sealing area of the disc.

The combination of the alternating vents and rupturable bridges and the repeating fracture pattern formed therewith enables the disc to be attached to the rim of the dispensing opening of the container without the need for centering or indexing the design in the installation process.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
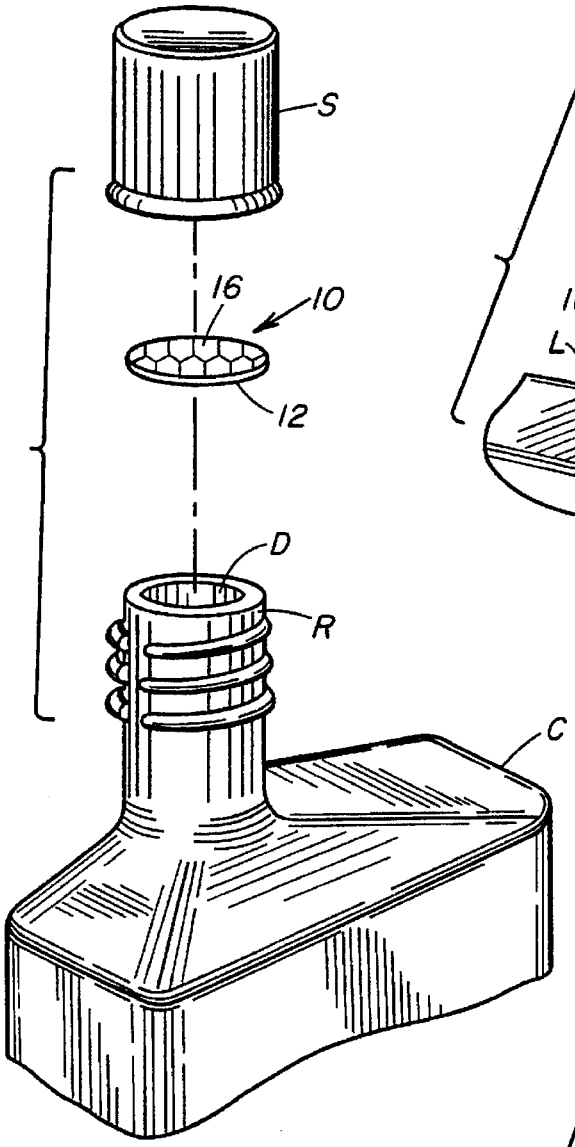
FIG. 1 is an exploded fragmentary perspective view of the disc having the repeating vented fracture pattern thereon of the venting and flow control closure device of the present invention shown positioned between a dispensing opening of a liquid container and a screw cap.
Figure 2:
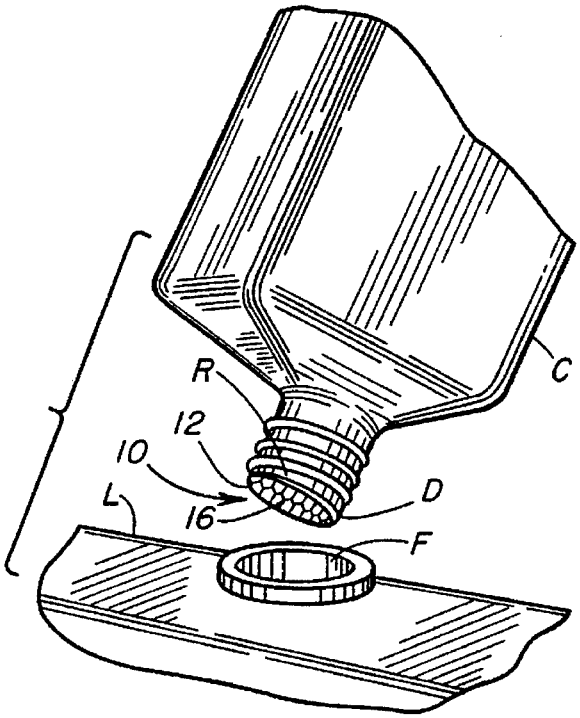
FIG. 2 is a fragmentary perspective view of the device shown in an unruptured state attached to a rim of the dispensing opening of the liquid container positioned over a filler opening of a receptacle for receiving the contents of the container shown on a reduced scale.
Figure 3:
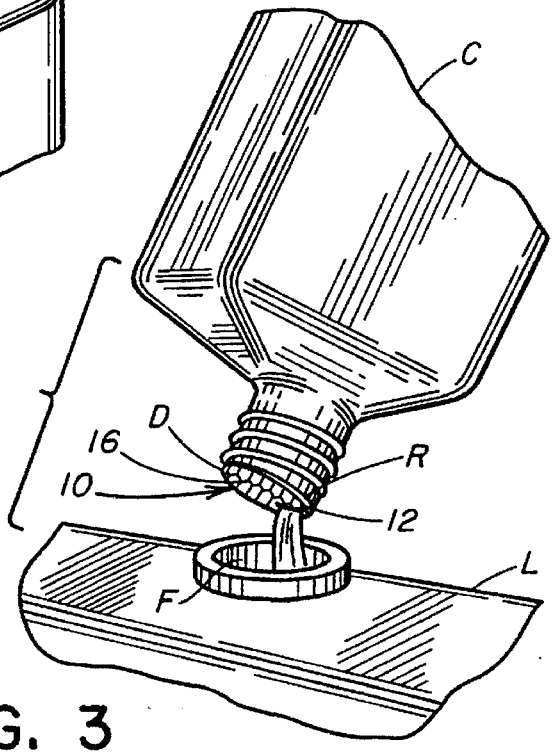
FIG. 3 is the same fragmentary perspective view of the device in FIG. 2 except showing the device in the ruptured state with the contents of the liquid container pouring out therefrom into the receptacle.
Figure 4:
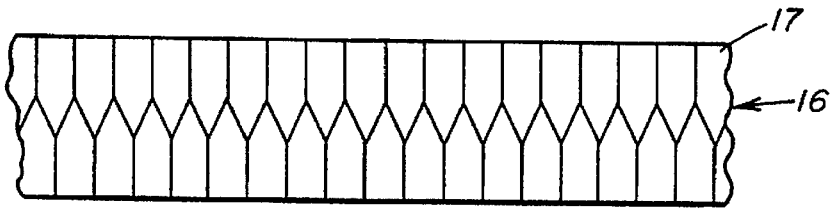
FIG. 4 is an enlarged fragmentary top plan view of a continuous strip of metal foil material having the repeating fracture pattern applied thereon and from which are fabricated a multiplicity of disks each forming the closure device of the present invention.

Referring to the drawings, and particularly to FIGS. 1 to 3 and 5, there is illustrated a venting and flow control closure device, generally designated 10, of the present invention for use with a dispensing opening D of a liquid container C. The closure device 10 is particularly designed to address the problem of spillage associated with lowering the liquid container C to a normal pouring position, as shown in FIGS. 2 and 3, in areas such as under the hood of vehicles having limited space. This is particularly important in dealing with those liquids such as motor oil which pose an environmental contamination and waste problem when not disposed of by a proper means.

The venting and flow control closure device 10 of the present invention retains the approach in the prior art to provide a closure for covering the dispensing opening D which can be ruptured after the liquid container C is positioned properly over a filler opening F of a liquid receptacle L. As will be described below, additionally the device 10 has a rupturable fracture pattern thereon adapted to permit automatic adjustment of the internal pressure of the container C to the atmospheric pressure by allowing air to be exchanged through vents formed in the fracture pattern of the closure device 10. The fracture pattern further retains the integrity of the closure by allowing liquid stored in the container C to pass through the vents of the fracture pattern only at a rate which provides sufficient time for a user to place an uncapped inverted liquid container C over the filler opening F for reception of the contents of the container C before drops of liquid begin to seep out through the vents of the fracture pattern. The closure may then be ruptured by the user squeezing the opposite sides of the container C to thereby force liquid through the fracture pattern.

A problem generally exists, however, with the above described approach in that the prior art devices appear to provide only discrete fracture patterns and thus appear to require considerable centering control in the process of installation of the seal onto a rim R of the dispensing opening D of the container C. This centering control requirement appears to unnecessarily add to the complexity and costs of the seal installation process. The closure device 10 described hereinafter particularly provides a solution to this problem arising from the prior art devices which have discrete fracture patterns.

Figure 6:
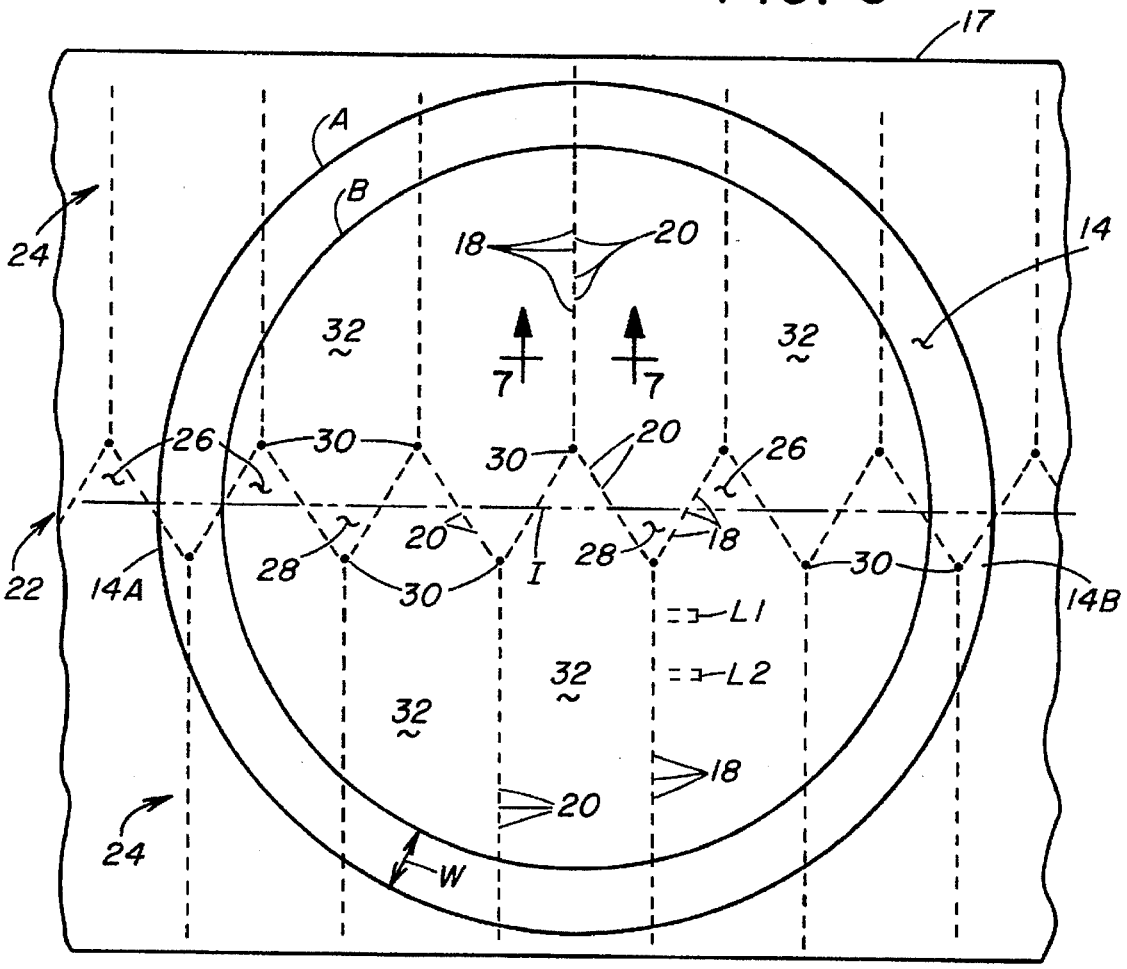
FIG. 6 is an enlarged diagrammatic view of the repeating fracture pattern of the strip superimposed over the sealing area of the disc of the closure device as represented by the area disposed between and bounded by two concentric circles where each disk fabricated from the strip is attached to the rim of the liquid container encompassing the dispensing opening thereof.

The venting and flow control closure device 10 of the present invention basically includes a disc 12 having a peripheral annular sealing area 14 attachable to the rim R which encircles the dispensing opening D of the liquid container C and means defining a repeating vented fracture pattern 16 formed on the disc 12 and extending from a first edge 14A to an opposite second edge 14B of the peripheral annular sealing area 14 of the disc 12. As seen in FIG. 6, the annular sealing area 14 is disposed between and bounded by two concentric circles A, B where each disk 12 fabricated from a strip 17 is attached to the rim R of the liquid container C encompassing the dispensing opening D.

The repeating fracture pattern 16 is adapted to provide automatic adjustment of the internal pressure of the liquid container C to the atmospheric pressure by allowing air to be exchanged therethrough and is adapted to allow for passage of the liquid stored in the container C at a rate which provides sufficient time for a user to place an uncapped inverted container C having the closure device 10 thereon over a filler opening F for reception of the contents of the container C before drops of liquid begin to seep out through the repeating fracture pattern 16 of the closure device 10. The fracture pattern 16 further is rupturable by the user squeezing the container C and forcing liquid therethrough.

Using conventional techniques, multiple discs 12 are preferably cut from the continuous strip 17 which is made substantially of a metal foil material which can be substantially identical to that in current use, such as 3M Safe-Gard (TM) 75M innerseal, a recyclable aluminum foil which provides a fused, tamper evident seal over the dispensing opening D of the liquid container C. The disc 12 is designed for use with a screw cap S which serves to prevent liquid which may pass through the vents of the repeating fracture pattern 16 from escaping into the external environment. The interior top of the cap S is flat and in contact with the foil disc 12. This backing prevents movement and fracturing of the foil disc 12 if the liquid container C is pressurized during shipping and handling.

The foil disc 12 is attached to the rim R of the liquid container C in the peripheral annular sealing area 14 in a manner common in the industry. The 75M innerseal particularly has a 0.5 millimeter polyester film layer coated thereover with a 1.5 millimeter polyethylene heat seal layer, which is heated to form a bond with the rim R. The disc 12 may further be torn away from the rim R of the container C by fingers or may also be ruptured at the vents of the repeating fracture pattern 16 by finger pressure. After attachment to the rim R of the dispensing opening D of the container C, the peripheral annular sealing area 14 of the disc 12 remains attached thereto even after the repeating fracture pattern 16 of the disc 12 is ruptured.

Figure 7:
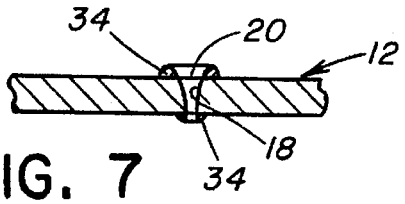
FIG. 7 is an enlarged cross-sectional view of the disk taken along line 7—7 of FIG. 6 showing a vent and adjacent bridges of the repeating fracture pattern and a vent reinforcing ring of the closure device.
Figure 5:
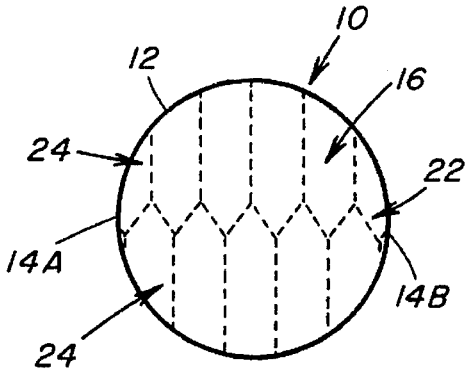
FIG. 5 is an enlarged top plan view of a closure device disk fabricated from the continuous strip of metal foil material of FIG. 4, with the disk containing a section of the repeating fracture pattern thereon.

Referring now to FIGS. 4 to 7, the means defining the repeating vented fracture pattern 16 is a plurality of vents 18 and rupturable bridges 20 alternating and arranged end-to-end with one another. Each vent 18, as seen in FIG. 7, extends completely through the disk 12 and has a length L1, whereas each bridge 20 is a solid portion of the disk 12 extending between adjacent vents 18 and has a length L2. The length L1 of each vent 18 is substantially greater than the length L2 of each bridge 20. For instance, in one example the length L1 of the vent 18 is generally 0.040 inches, whereas the length L2 of the bridge 20 generally ranges from 0.001 to 0.005 inches. Also, in the one example, the annular sealing area 14 has a width W of generally 0.050 inches across the rim R of the liquid container C being greater than the length L1 of the vent 18 so that at continuous bond exists between the disc 12 and the rim R.

The length L2 of each bridge 20 also substantially determines the pressure at which the bridge 20 will rupture. An increase in the length L2 of the bridge 20 accordingly increases the pressure required to rupture the bridge 20. The length L2 of each bridge 20 is therefore adjustable to accommodate different desired fracture points. More particularly, for a pattern 16 of a given dimension, an increase in the length LS of the bridges 20 necessitates a decrease in the length L1 of the vents 18 thereby reducing the degree to which the metal foil material is weakened by the presence of the vents 18 and accordingly increasing the pressure required to rupture the bridges 20.

The repeating fracture pattern 16 includes a central portion 22 and a pair of opposite side portions 24 extending in opposite directions outwardly from the central portion 22. The central portion 22 preferably is made up of the alternating end-to-end vents 18 and bridges 20 defined in a substantially zig-zag shaped path having peaks 26 and valleys 28, with each of the peaks 26 and valleys 28 terminating in a round hole 30. The length L1 of each vent 18 is also substantially greater than a diameter of each round hole 26, which in one example is generally 0.001 inches.

The opposite side portions 24 of the repeating fracture pattern 16 are preferably made up of respective pluralities of spaced apart substantially parallel linear paths of the alternating end-to-end vents 18 and bridges 20 extending outwardly from each of the round holes 30 at the peaks 26 and valleys 28 of the central portion 22 in substantially perpendicular relation to an imaginary line I dividing the zig-zag path of the central portion 22 into halves with all of the peaks 26 in one half and all of the valleys 28 in the other half. As best seen in FIG. 6, these outwardly extending parallel linear paths of the side portions 24 of the repeating fracture pattern 16 generally terminate in the peripheral annular sealing area 14 of the disc 12. Upon rupture of the disk 12 of the closure device 10, the zig-zag path of the central portion 22 and the parallel linear paths of the opposite side portions 24 of the repeating fracture pattern 16 results in transformation of the disk into a plurality of substantially leaf-shaped fractures 32. The leaf-shaped fractures 32 remain attached to the rim R of the container C after rupture of the disk 12 of the closure member 10 and their leaf-shaped configurations results in retention of less liquid thereon than with other possible designs.

Furthermore, referring to FIG. 7, a conventional die-cutting tool is used to form the vents 18 of the repeating fracture pattern 16. The formation of the vent 18 creates a plurality of vent reinforcing rings 34 thereabout resulting from displacement or pushing aside of metal foil in the process of forming the vents 18. These vent reinforcing rings 34 completely surround each of the vents 18 and generally help to prevent pre-mature rupture of the adjacent bridges 20 between the vents 18. The vent reinforcing rings 34 further aid in maintenance of the contour of each vent 18 and therefore provide the most efficient flow of air and liquid therethrough.

The repeating nature of the fracture pattern 16 of the present invention particularly provides the closure device 10 with a substantial advantage over prior art devices in that no indexing in the installation process is required. The necessity for indexing generally arises, as described above with regard to the prior art, when the fracture pattern is discrete which requires centering of the particular design over the dispensing opening D of the container C. In the present invention, however, the repeating nature of the fracture pattern 16 eliminates any need for centering the design over the dispensing opening D and permits the disc 12 to be formed by die-cutting it from the long substantially continuous strip 17 of the metal foil which already has the repeating vented fracture pattern 16 defined therein. It is therefore the combination of the alternating vents 18 and rupturable bridges 20 and the repeating fracture pattern 16 formed therewith which enables the disc 12 to then be attached to the rim R of the dispensing opening D of the container C without the need for centering or indexing thereof.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A venting and flow control closure device for use with a dispensing opening of a liquid container, said device comprising:

(a) a disc having a peripheral sealing area attachable to a rim encircling the dispensing opening of the container; and (b) means defining a repeating vented fracture pattern formed on said disc and extending from a first edge to an opposite second edge of said peripheral sealing area of said disc, said repeating fracture pattern including a plurality of spaced vents formed through the disc so as to communicate with atmospheric pressure at the exterior of the container and thereby provide automatic adjustment of the internal pressure of the container to the atmospheric pressure by allowing air to be exchanged through said vents of said repeating fracture pattern and being adapted for passage of the liquid stored in the container at a rate which provides sufficient time for a user to place an uncapped inverted container over a receptacle opening for reception of the container's contents before drops of the liquid begin to seep out through said vents of said repeating fracture pattern.

2. The device of claim 1 wherein said disc is made substantially of a metal foil material.

3. The device of claim 1 wherein said repeating fracture pattern of said disc is rupturable by the user squeezing the container and forcing the liquid through said repeating fracture pattern.

4. The device of claim 3 wherein said peripheral sealing area of said disc after attachment to the rim of the dispensing opening of the container is continuous so as to remain attached thereto after said repeating fracture pattern of said disc is ruptured.

5. The device of claim 1 wherein said means defining said repeating fracture pattern is a plurality of said vents alternating with a plurality of rupturable bridges.

6. The device of claim 5 wherein said vents have a length substantially greater than that of said bridges.

7. The device of claim 5 wherein said peripheral sealing area of said disc has a width across the rim of the container which is greater than a length of said vent so that a continuous bond will exist between said disc and the rim.

8. A venting and flow control closure device for use with a dispensing opening of a liquid container, said device comprising:

(a) a disc having a peripheral sealing area attachable to a rim encircling the dispensing opening of the container; and (b) means defining a repeating vented fracture pattern formed on said disc and extending from a first edge to an opposite second edge of said peripheral sealing area of said disc and including a central portion being substantially zig-zag in shape and having peaks and valleys, said means defining said repeating fracture pattern being adapted to provide automatic adjustment of the internal pressure of the container to the atmospheric pressure by allowing air to be exchanged therethrough and being adapted for passage of the liquid stored in the container at a rate which provides sufficient time for a user to place an uncapped inverted container over a receptacle opening for reception of the container's contents before drops of the liquid begin to seep out through said repeating fracture pattern.

9. The device of claim 8 wherein said means defining said repeating fracture pattern further includes a pair of opposite side portions extending outwardly from said peaks and valleys of said central portion.

10. The device of claim 9 wherein said pair of opposite side portions of said repeating fracture pattern extends in substantially perpendicular relation to an imaginary line dividing said zig-zag pattern of said central portion into halves with said peaks in one said half and said valleys in the other said half.

11. The device of claim 9 wherein said outwardly extending side portions of said repeating fracture pattern terminate in said peripheral sealing area of said disc.

12. The device of claim 8 wherein each of said peaks and valleys of said central portion of said repeating fracture pattern terminates in a round hole.

13. The device of claim 8 wherein said means defining said repeating fracture pattern includes a plurality of alternating vents and rupturable bridges, each of said vents having a length substantially greater than a diameter of each of said round holes.

14. A venting and flow control closure device for use with a dispensing opening of a liquid container, said device comprising:

(a) a metal foil disc having a peripheral sealing area attachable to a rim encircling the dispensing opening of the container;

(b) a repeating vented fracture pattern having a central portion being substantially zig-zag in shape with peaks and valleys and having a plurality of alternating vents and rupturable bridges formed on said disc and extending from a first edge to an opposite second edge of said peripheral sealing area of said disc;

(c) said repeating fracture pattern being adapted to provide automatic adjustment of the internal pressure of the container to the atmospheric pressure by allowing air to be exchanged therethrough and being adapted for passage of the liquid stored in the container at a rate which provides sufficient time for a user to place an uncapped inverted container over a receptacle opening for reception of the container's contents before drops of the liquid begin to seep out through said vents of said repeating fracture pattern;

(d) said repeating fracture pattern on said disc further being rupturable by the user squeezing the container and forcing liquid through said vents of said repeating fracture pattern; and (e) said alternating vents and said rupturable bridges and said repeating fracture pattern formed therewith enabling said disc to be attached to the rim of the dispensing opening of the container without the need for indexing or centering of the design in the installation process.

15. The device of claim 14 wherein said peripheral sealing area of said disc after attachment to the rim of the dispensing opening of the container is continous so as to remain attached thereto after said repeating fracture pattern of said disc is ruptured.

16. The device of claim 14 wherein said vents have a length substantially greater than that of said bridges.

17. The device of claim 14 wherein said peripheral sealing area of said disc has a width across the rim of the container which is greater than a length of said vent so that a continuous bond exists between said disc and the rim.

18. The device of claim 14 wherein said means defining said repeating fracture pattern further includes a pair of opposite side portions extending outwardly from said peaks and valleys of said central portion.

19. The device of claim 18 wherein said pair of opposite side portions of said repeating fracture pattern extends in substantially perpendicular relation to an imaginary line dividing said zig-zag pattern of said central portion into halves with said peaks in one said half and said valleys in the other said half.

20. The device of claim 18 wherein said outwardly extending side portions of said repeating fracture pattern terminate in said peripheral sealing area of said disc.

21. The device of claim 14 wherein each of said peaks and valleys of said central portion of said repeating fracture pattern terminates in a round hole.

22. The device of claim 21 wherein each of said vents of said repeating fracture pattern has a length substantially greater than a diameter of each of said round holes.

* * * * *